United States Patent [19]

Krämer

[11] 4,075,995

[45] Feb. 28, 1978

[54] FUEL INJECTION SYSTEM

[75] Inventor: Manfred Krämer, Schwieberdingen, Germany

[73] Assignee: Robert Bosch GmbH, Stuttgart, Germany

[21] Appl. No.: 650,735

[22] Filed: Jan. 20, 1976

[30] Foreign Application Priority Data

Jan. 21, 1975 Germany ..... 2502153

[51] Int. Cl.[2] ..... F02M 69/00

[52] U.S. Cl. ..... 123/139 AW; 261/50 A

[58] Field of Search ..... 261/50 A; 123/119 R, 123/139 AW, 140 MC

[56] References Cited

U.S. PATENT DOCUMENTS

| | | | |
|---|---|---|---|
| 3,835,828 | 9/1974 | Knapp | 123/139 AW X |
| 3,842,813 | 10/1974 | Eckert | 123/139 AW X |
| 3,930,481 | 1/1976 | Eckert | 123/139 AW |
| 3,983,849 | 10/1976 | Stumpp | 123/139 AW X |

*Primary Examiner*—Charles J. Myhre
*Assistant Examiner*—Tony M. Argenbright
*Attorney, Agent, or Firm*—Edwin E. Greigg

[57] ABSTRACT

A fuel injection system for internal combustion engines includes an airflow measuring member which actuates a fuel metering valve assembly. The pressure drop across this valve assembly may be changed by changing the restoring force on the movable control slide therein. The restoring force is provided by pressurized fluid, for example fuel, and the pressure of this fluid can be adjusted by an electro-magnetic pressure modulator, in turn controlled by an electronic controller responsive to engine conditions as sensed by transducers. A pressure limiting valve further influences the control fluid pressure.

5 Claims, 2 Drawing Figures

FUEL INJECTION SYSTEM

BACKGROUND OF THE INVENTION

The invention pertains to a fuel-injection system for mixture-compressing combustion-engines employing external ignition and operating with continuous fuel injection into the induction tube. Deployed successively in the induction tube are a metering-member and an arbitrarily operable throttle-flap. The metering-member is actuated against a restoring-force in compliance with the air-flow rate, thereby positioning a control-slide serving as the moving part of a metering valve situated in the fuel-supply-line, to allocate a fuel-quantity in proportion to the air-quantity. The restoring-force is generated by fluid pressure acting on the control-slide.

Fuel-injection systems of this type have the purpose of providing, automatically, a favorable fuel-air mixture for all the operating requirements of the combustion engine, in order that complete combustion of the fuel shall occur, so that, while the output of the combustion engine is being maximized, and the fuel consumption minimized, the production of poisonous exhaust gases is prevented or, at the least, greatly reduced. The fuel quantity must therefore be precisely allocated according to the demands of all the operating conditions of the combustion engine, and the ratio of the air quantity to the fuel quantity must be changed as a function of the known operating variables, such as, for example, revolutions per unit time, load, temperature, and the chemical composition of the exhaust gases.

In familiar fuel-injection systems of this type, the fuel quantity is allocated in a preferably direct proportion to the air quantity flowing through the induction tube and the relationship between the allocated fuel quantity and the air quantity is changeable by changing the restoring force on the metering member as a function of known operating variables of the combustion engine, through an electro-magnetically actuated pressure-regulating valve.

OBJECT AND SUMMARY OF THE INVENTION

It is a principal object of the present invention to provide a fuel injection system of this known type, in which, with due consideration of the demands made upon this kind of fuel-injection system, and without large expenditure, a plain and precise modulation of the restoring force as a function of known operating variables of the combustion engine is achieved.

The present invention attains this object by providing an electro-magnetic fluid pressure modulator which varies the pressure of the pressurized fluid, and consequently varies the restoring force acting on the air-flow rate member as a function of the known operating variables of the combustion-engine.

An advantageous configuration of the invention provides that the pressurized fluid is continually conveyed through a control pressure line separated from the fuel supply line by a de-coupling throttle, while the control pressure line contains a pressure-limiting valve, whose movable valve member is impinged upon on one side by the pressure in the control-pressure line, and on the other side by a compression-spring and by the pressure in the control line of the electro-magnetic fluid pressure modulator.

In a further, advantageous configuration of the invention, the pressure-limiting valve is constructed as a valve having a flat seat, with a diaphragm constituting the movable valve component, where that diaphragm surface which is exposed to the control-pressure in the control pressure line has a smaller cross-sectional area than the diaphragm surface which faces the control line of the electro-magnetic fluid-pressure modulator.

Another advantageous configuration of the invention arises from the fact that a piston-type pressure regulator serves for the regulation of the fuel pressure in the fuel supply line, and it actuates a return-flow valve located in the return-flow line of the electro-magnetic fluid pressure modulator.

The invention will be better understood as well as further objects and advantages thereof become more apparent from the ensuing detailed description of two preferred embodiments, taken in conjunction with the drawing.

DESCRIPTION OF THE PREFERRED EMBODIMENTS

Figure 1:
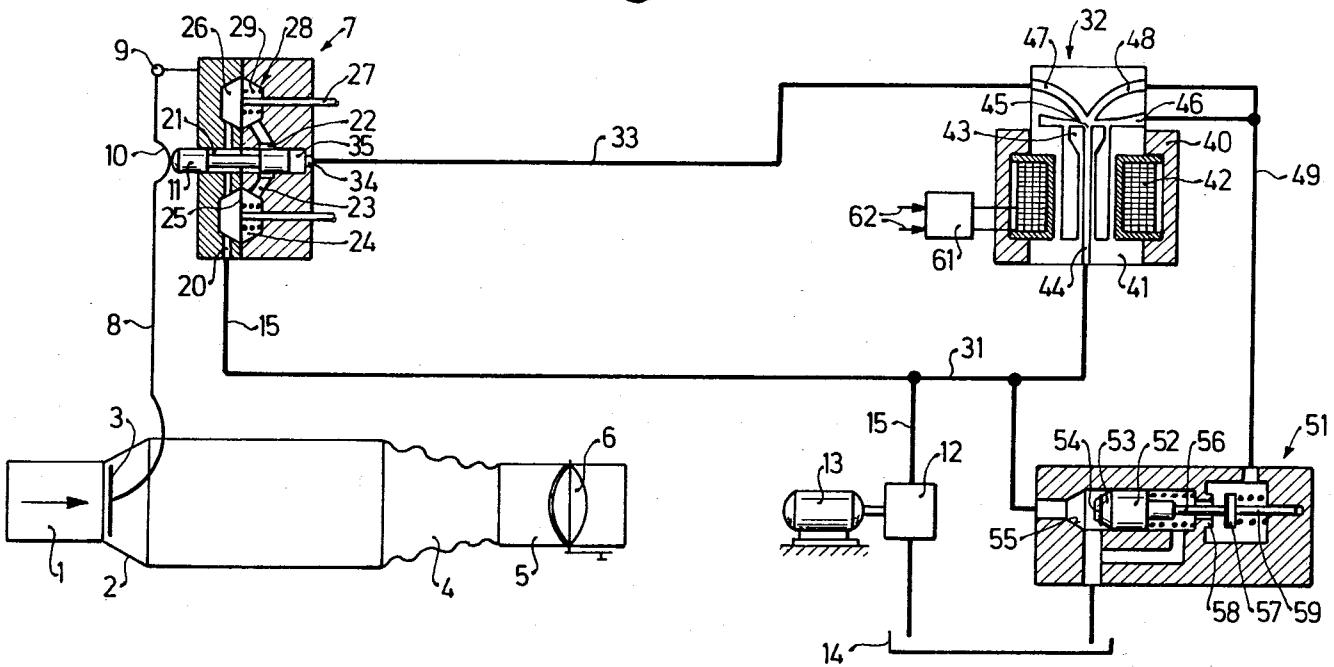
FIG. 1 is a schematic diagram of a first embodiment of the fuel injection system according to the invention.

In the fuel injection system presented in FIG. 1, the combustion air flows in the direction of the arrow into an induction tube 1, a conical region 2 whereof contains an air-flow metering member 3. Subsequently the air flows through a connecting-hose 4 and an induction tube region 5, including an arbitrarily operable throttle flap 6, and then flows to one or several cylinders, (not shown), of an internal combustion engine. The metering member is a plate 3, oriented transversely with respect to the direction of air flow, and moving within the conical region as a nearly linear function of the air mass flowing through the induction-tube, whereby, for a constant restoring force acting on the metering member 3, and a concurrent constant air-pressure upstream of the metering member, the air-pressure prevailing between the metering member 3 and the throttle flap 6 likewise remains constant.

The metering member 3 directly controls a metering and distributing valve 7. Serving to convey the displacing motion of the metering member 3 is an attached lever 8 which swivels on a, preferably, frictionless bearing about a pivot point 9, and with this swivelling motion, and via a nose 10, the lever 8 actuates the movable valve component of the metering and distributing valve 7, whose movable valve component is a control slide 11. The fuel is supplied by a fuel pump 12, which, driven by the electric motor 13, pumps the fuel from a fuel tank 14, and transports it via a fuel supply line 15 to the metering and distributing valve 7.

From the fuel supply line 15, the fuel reaches a conduit 20 in the housing of the metering and distributing valve 7, and subsequently reaches an annular groove 21 in the control slide 11. Depending upon the given position of the control slide 11, the annular groove 21 opens to a varying extent control-ports 22, each of which leads via conduits 23 to a first chamber 24, which is separated from the second chamber 26 by a diaphragm 25. From the first chambers 24, and via the conduits 27, the fuel reaches the individual injection-valves, (not shown), which are located within the induction tube in the vicinity of the engine cylinders. The diaphragm 25 serves as the movable component of a flat-seated differential-pressure valve 28, which is held in the opened position by a spring 29 so long as the fuel injection system is not in operation. The diaphragm valves, formed by chambers 24 and 26, have the effect that the pressure gradient at the effective metering assembly 21, 22 remain substantially constant, independent of the amount of overlap between the annular-groove 21 and the control-ports 22, and hence independent of the fuel quantity flowing to the injection valves. Thus, the length of the displacement path of the control slide 11 is proportional to the apportioned fuel quantity.

A swivelling motion of the lever 8 moves the metering member 3 into the conical region 2 of the induction tube 1, so that the resultant changing annular cross-section between the metering member and the conical tube region is proportional to the length of the displacement path of the metering member 3.

From the fuel supply line 15, a line 31 branches off to the inlet of an electro-magnetic fluid pressure modulator 32, one outlet of which is connected to a pressure chamber 35 via a control line 33 including a damping throttle 34. The front face of the control-slide 11 remote from the lever 8 extends into the pressure chamber 35.

The electro-magnetic fluid pressure modulator or converter 32 is of a known type having a permanent magnet 40, a core 41, a coil 42, and an armature 43. The armature 43 contains a pressure line 44, which is connected to the line 31, and which opens into a hollow space 46 via a nozzle 45. Opposite the nozzle 45 are located two outlet conduits 47 and 48, which are constructed as diffusers, and which are separated from each other by a flow divider. At their other ends, the diffusers lead, respectively, to the control line 33, and to a return flow line 49. The hollow space 46 is likewise connected to the return flow line 49. A suitable modulator or converter is described, e.g., in U.S. Pat. No. 3,774,644.

Situated in the return flow line 49 is a return flow valve assembly 51, which is actuated by a pressure regulator piston 52. The pressure regulator piston 52 has a conical end 53, on which is positioned an elastic annular gasket 54. The conical end 53 works in conjunction with a conical valve-seat 55. The pressure regulator piston 52 serves to regulate the fuel pressure in the fuel supply line 15, so that, as the fuel pressure rises beyond a pre-determined value, fuel may flow back from the fuel supply line 15 to the fuel tank 14. The pressure regulator piston 52 is spring loaded in the closed direction. Simultaneous with its own opening motion and by means of the pin 56, the piston 52 opens the return flow valve 51, formed by a valve plate 57, which is spring loaded in the closed direction and cooperates with a fixed valve seat 58. The valve plate 57 is guided axially by means of a guide rod 59.

The electro-magnetic fluid pressure modulator 32 is controlled by means of the electronic controller 61, which receives data regarding the known operating variables of the combustion engine from data sensors, (not shown), via lines symbolized by arrows 62. For example, pressure cells, temperature probes, or an oxygen detector for the determination of the chemical composition of the exhaust-gases may all serve as data sensors.

The operation of the fuel injection system in FIG. 1 is as follows:

Whenever the internal combustion engine is running, air is aspirated through the induction tube 1, 4, and 5, and causes a certain specific displacement of the metering member 3 from its rest position. In unison with the displacement of the metering member 3, the control slide 11 of the metering and distributing valve 7, which allocates the fuel quantity flowing to the injection valves, is also displaced by means of the lever 8. The direct connection between the metering member 3 and the control slide 11 results in a constant relationship of the flowing air mass and the allocated fuel-quantity, insofar as, and provided that, the characteristic operating behavior of these two elements is sufficiently linear, which condition is inherently sought. In order that the fuel-air mixture may be maintained either richer or leaner according to the particular given point of the operational range of the internal combustion engine, it is necessary to provide a dynamic adjustment of the otherwise inherently constant restoring force acting on the metering member 3, in compliance with, and response to, the known operating variables, such as, for example, revolutions per unit time, load, temperature, or the chemical composition of the exhaust gases, of the combustion engine. To this end, the pressure chamber 35 is connected to the control line 33 of the electro-magnetic fluid-pressure modulator 32. The electrofluidic modulator 32 is controlled by the electronic controller 61. The superposition of the magnetic field generated by the coil 42 and the magnetic field of the permanent magnet 40 causes the displacement to varying degrees of the elastically attached armature 43 from its normal position. As a consequence, the jet emerging from the nozzle 45 causes a corresponding increase or decrease of the pressure in the outlet channels 47, 48 and the change of the pressure in the chamber 35 results in a changed restoring force.

Figure 2:
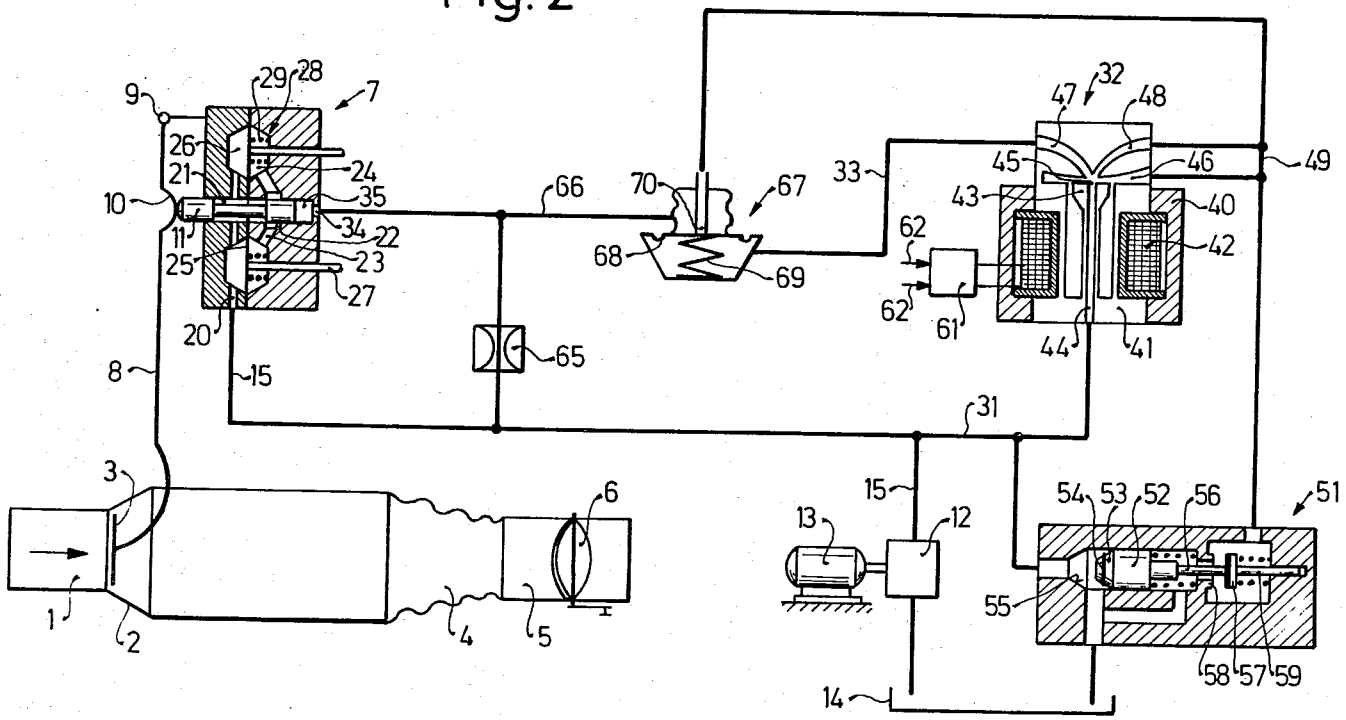
FIG. 2 is a schematic diagram of a second embodiment of the fuel injection system according to the invention.

In the second exemplary embodiment according to FIG. 2, those elements which are identical to elements of FIG. 1 retain the same reference numerals. In the second exemplary embodiment according to FIG. 2, the change of the restoring force acting on the member 3 is exerted by supplying the fuel continuously through a control pressure line 66 which is decoupled from the main fuel supply line 15 by a decoupling throttle 65. The control pressure line 66 contains a pressure limiting valve 67 which has a diaphragm 68 acting as its movable valve member. One side of the diaphragm is engaged by the pressure prevailing in the control pressure line 66 and the other side of the diaphragm is engaged by a compression spring 69 and by the pressure prevailing in the control line 33 of the electrofluidic modulator 32. The pressure-limiting valve 67 includes a fixed valve seat 70, over which the fuel may flow into the return flow line 49. The use of a pressure-limiting valve 67 according to the invention may be required to provide a step-up of pressure, in order that the pressure in the control line 33 might modulate a higher control pressure in the control pressure line 66.

For this purpose, the diaphragm 68 can be appropriately constructed in such a manner that the surface impinged upon by the control pressure in the control pressure line 66 shall have a smaller cross-sectional area than the surface facing the control line 33 of the electromagnetic fluid pressure modulator 32.

What is claimed is:

1. A fuel injection system for an internal combustion engine, said engine including a fuel tank, an air induction tube containing an air flow rate meter and a throttle valve and transducer means for generating signal related to engine conditions, said fuel injection system including a source of pressurized control fluid and fuel metering means incorporating a control slide which is displaced in one sense by said air flow rate meter and which is urged in the opposite, return, sense by control fluid, the improvement comprising:

an electromagnetic fluid pressure modulator, having a housing and an outlet connected to said control slide for exerting variable pressure on said control fluid, said pressure modulator having internal fluid compartments in said housing and including electromagnetically actuated means for adjusting the spatial direction of the flow of fluid selectively within said compartments and toward said outlet to thereby determine the static pressure at said outlet and at said control slide, said modulator being connected to said transducer means to receive said signals related to engine conditions.

2. A fuel injection system as defined by claim 1, the improvement further comprising a decoupling throttle, disposed between said source of pressurized fluid and said control slide for providing return control fluid pressure to said control slide, and a pressure limiting valve, connected between the downstream side of said de-coupling throttle and said fluid pressure modulator, said pressure limiting valve being urged in the opening sense by the pressure of said control fluid and in the opposite sense by the pressure delivered by said fluid pressure modulator, said pressure limiting valve including a compression spring for aiding the closure thereof.

3. A fuel injection system as defined by claim 2, wherein said pressure limiting valve is a flat-seat valve having a diaphragm as its moving valve member.

4. A fuel injection system as defined by claim 3, wherein said diaphragm has two surfaces and wherein one of said surfaces is subject to the pressure of said control fluid and has a smaller area than the other of said surfaces which is subject to the pressure of fluid as provided by said fluid pressure modulator.

5. A fuel injection system as defined by claim 1, the improvement further comprising:

a pressure regulator including a plunger valve, connected to said source of pressurized fluid and to said pressure modulator and being actuated by the respective pressures thereof to provide for return flow of fluid from said modulator to said fuel tank; whereby the pressure in said source of pressurized fluid is regulated.

* * * * *